US008333850B2

(12) United States Patent
Gong et al.

(10) Patent No.: US 8,333,850 B2
(45) Date of Patent: Dec. 18, 2012

(54) ZR-BASED AMORPHOUS ALLOY AND METHOD OF PREPARING THE SAME

(75) Inventors: Qing Gong, Shenzhen (CN); Faliang Zhang, Shenzhen (CN); Yunchun Li, Shenzhen (CN); Jiangtao Qu, Shenzhen (CN); Xiaolei Hu, Shenzhen (CN)

(73) Assignee: BYD Company Limited (CN)

( * ) Notice: Subject to any disclaimer, the term of this patent is extended or adjusted under 35 U.S.C. 154(b) by 0 days.

(21) Appl. No.: 13/310,018

(22) Filed: Dec. 2, 2011

(65) Prior Publication Data

US 2012/0073707 A1 Mar. 29, 2012

Related U.S. Application Data

(63) Continuation of application No. 13/148,725, filed as application No. PCT/CN2010/078014 on Oct. 22, 2010, now abandoned.

(30) Foreign Application Priority Data

Oct. 30, 2009 (CN) ..... 2009 1 0209456
May 31, 2010 (CN) ..... 2010 1 0201008

(51) Int. Cl.
*C22C 45/10* (2006.01)

(52) U.S. Cl. ..... 148/538; 148/403; 148/421; 148/561; 420/423; 164/61

(58) Field of Classification Search ..... None
See application file for complete search history.

(56) References Cited

U.S. PATENT DOCUMENTS

| | | | | |
|---|---|---|---|---|
| 5,288,344 | A | 2/1994 | Peker et al. | |
| 5,368,659 | A | 11/1994 | Peker et al. | |
| 5,797,443 | A * | 8/1998 | Lin et al. | 164/4.1 |
| 6,374,899 | B1 | 4/2002 | Yamaguchi et al. | |
| 6,562,156 | B2 * | 5/2003 | Liu | 148/561 |
| 6,682,611 | B2 * | 1/2004 | Zhang et al. | 148/561 |
| 6,709,536 | B1 | 3/2004 | Kim et al. | |
| 6,805,758 | B2 * | 10/2004 | Wolter | 148/403 |
| 6,896,750 | B2 | 5/2005 | Wolter | |
| 7,008,490 | B2 * | 3/2006 | Peker | 148/561 |
| 7,153,376 | B2 | 12/2006 | Wolter | |
| 7,244,321 | B2 | 7/2007 | Kim et al. | |
| 7,357,731 | B2 | 4/2008 | Johnson et al. | |

(Continued)

FOREIGN PATENT DOCUMENTS

CN 1548572 A 11/2004

(Continued)

OTHER PUBLICATIONS

Machine Translation of JP 2000-234156, published Aug. 29, 2000.*

(Continued)

*Primary Examiner* — George Wyszomierski
(74) *Attorney, Agent, or Firm* — Greenberg Traurig LLP

(57) ABSTRACT

A Zr-based amorphous alloy and a method of preparing the same are provided. The Zr-based amorphous alloy is represented by the general formula of $(Zr_aM_{1-a})_{100-x}O_x$, in which a is an atomic fraction of Zr, and x is an atomic percent of 0, in which: $0.3 \leqq a \leqq 0.9$, and $0.02 \leqq x \leqq 0.6$; and M represents at least three elements selected from the group consisting of transition metals other than Zr, Group IIA metals, and Group IIIA metals.

13 Claims, 3 Drawing Sheets

U.S. PATENT DOCUMENTS

| | | | | |
|---|---|---|---|---|
| 2003/0075246 | A1 | 4/2003 | Peker | |
| 2003/0217790 | A1 | 11/2003 | Wolter | |
| 2004/0084114 | A1 | 5/2004 | Wolter | |
| 2004/0216812 | A1 | 11/2004 | Wolter | |
| 2006/0108033 | A1* | 5/2006 | Peker et al. | 148/561 |
| 2006/0154745 | A1 | 7/2006 | Johnson et al. | |
| 2007/0107810 | A1 | 5/2007 | Farmer | |
| 2007/0131312 | A1 | 6/2007 | Kim et al. | |
| 2008/0190521 | A1 | 8/2008 | Loffler et al. | |
| 2009/0139612 | A1 | 6/2009 | Lu et al. | |
| 2011/0094633 | A1 | 4/2011 | Gong et al. | |
| 2011/0097237 | A1 | 4/2011 | Gong et al. | |
| 2011/0280761 | A1 | 11/2011 | Gong et al. | |
| 2011/0308671 | A1 | 12/2011 | Gong et al. | |
| 2012/0067466 | A1 | 3/2012 | Gong et al. | |
| 2012/0073706 | A1 | 3/2012 | Gong et al. | |
| 2012/0073707 | A1 | 3/2012 | Gong et al. | |
| 2012/0073709 | A1 | 3/2012 | Gong et al. | |

FOREIGN PATENT DOCUMENTS

| | | | |
|---|---|---|---|
| EP | 2103699 | A1 | 9/2009 |
| JP | 2000234156 | A | 8/2000 |
| WO | WO 2010130199 | A1 | 11/2010 |
| WO | WO 2011050695 | A1 | 5/2011 |

OTHER PUBLICATIONS

Patent Abstracts of Japan; Abstract for Japanese Publication No. 2000-234156; Downloaded from www.19.ipdl.inpit.go.jp/PA1/result/detail/main/wj6ljyaDA412234156P1.htm; Aug. 29, 2000; One page; Japan.

Jiang, F. et al.; "Formation of Zr-Based Bulk Metallic Glasses from Low Purity Materials by Scandium Addition;" Scripta Materialla, vol. 53, pp. 487-491; Jun. 2005.

Patent Cooperation Treaty; International Search Report Issued in Connection with International Application No. PCT/CN2010/072643; Aug. 12, 2010; 2 pages; China.

Patent Cooperation Treaty; PCT Written Opinion of the International Searching Authority; Issued in Connection with International Application No. PCT/CN2010/072643; Aug. 12, 2010; 3 pages; China.

Patent Cooperation Treaty; International Search Report Issued in Connection with International Application No. PCT/CN2010/078014; Jan. 27, 2011; 5 pages; China.

Patent Cooperation Treaty; PCT Written Opinion of the International Searching Authority; Issued in Connection with International Application No. PCT/CN2010/078014; Jan. 27, 2011; 6 pages; China.

U.S. Patent and Trademark Office; Non-Final Office Action Issued Against U.S. Appl. No. 12/890,063; Jan. 26, 2012; 9 pages; U.S.A.

U.S. Patent and Trademark Office; Non-Final Office Action Issued Against U.S. Appl. No. 13/310,128; Jan. 30, 2012; 9 pages; U.S.A.

U.S. Patent and Trademark Office; Non-Final Office Action Issued Against U.S. Appl. No. 12/904,497; Feb. 6, 2012; 13 pages; U.S.A.

U.S. Patent and Trademark Office; Non-Final Office Action Issued Against U.S. Appl. No. 13/148,725; Mar. 1, 2012; 9 pages; U.S.A.

He Lin et al., Effect of Oxygen on the Thermal Stability of Zr-Cu-Ni-Al-Ti Bulk Amorphous Alloy; Feb. 2006; vol. 42, No. 2; pp. 134-138; ACTA Metallurgica Sinica.

* cited by examiner

ZR-BASED AMORPHOUS ALLOY AND METHOD OF PREPARING THE SAME

CROSS REFERENCE TO RELATED APPLICATION:

This is a continuation of prior U.S. patent application Ser. No. 13/148,725, filed on Aug. 10, 2011 now abnadoned, which was a §371 national stage patent application based on International Patent Application No. PCT/CN2010/078014, filed on Oct. 22, 2010, entitled "Zr-BASED AMORPHOUS ALLOY AND METHOD OF PREPARING THE SAME," which claims the priority and benefit of Chinese Patent Application Number 200910209456.8 filed on Oct. 30, 2009 and Chinese Patent Application Number 201010201008.6, filed on May 31, 2010, which are each incorporated herein by reference in their entirety.

FIELD

The present disclosure relates to an amorphous alloy, more particularly to a Zr-based amorphous alloy and a method of preparing the same.

BACKGROUND

With the structure of long-range disorder but short-range order, amorphous alloys have excellent physical, chemical and mechanical properties, such as high strength, high hardness, high wear resistance, high corrosion resistance, high plasticity, high resistance, good superconductivity, and low magnetic loss; thus, they have been applied in a wide range of fields, such as mechanics, medical equipments, electrics, and military industries.

However, some inherent defects of the amorphous alloys may hamper their large-scale applications. For example, under load, amorphous alloys may not be deformed to resist the load, and finally may be suddenly broken when the stress reaches the fracture strength of the amorphous alloys, which may hamper wide application of the amorphous alloys.

SUMMARY

The present disclosure is directed to a Zr-based amorphous alloy with enhanced plasticity. Furthermore, a method of preparing the Zr-based amorphous alloy is also provided.

According to an aspect of the present disclosure, a Zr-based amorphous alloy represented by the general formula of $(Zr_aM_{1-a})_{100-x}O_x$ is provided, in which: a is atomic fraction of Zr, and x is atomic percent of oxygen, in which: $0.3 \leqq a \leqq 0.9$, and $0.02 \leqq x \leqq 0.6$; and M represents at least three elements selected from the group consisting of transition metals other than Zr, Group IIA metals, and Group IIIA metals in the Periodic Table of Elements. In an alternative embodiment, $0.4 \leqq a \leqq 0.7$; $0.03 \leqq x \leqq 0.5$; and M represents at least three elements selected from the group consisting of La series, Cu, Ag, Zn, Sc, Y, Ti, Zr, V, Nb, Ta, Cr, Mn, Fe, Co, Ni, Be, and Al, so that the Zr-based amorphous alloy may have enhanced plasticity.

In an embodiment, the Zr-based amorphous alloy may further have at least one of the following properties.

1) Based on the total volume of the Zr-based amorphous alloy, the Zr-based amorphous alloy may have a crystalline phase of less than about 70% by volume, and then the content of the amorphous phase will be more than about 30% by volume.

2) The Zr-based amorphous alloy may have multiple dimension sizes with at least one dimension size less than about 5 mm, preferably about 2 mm.

3) The Zr-based amorphous alloy may have a plastic strain of more than about 1%.

In an alternative embodiment, based on the total volume of the Zr-based amorphous alloy, the Zr-based amorphous alloy may have a crystalline phase of less than about 37% by volume, and then the content of the amorphous phase will be more than about 63% by volume.

According to another aspect of the present disclosure, a method of preparing a Zr-based amorphous alloy is provided. The method may comprise the steps of: mixing raw materials comprising Zr and M with a molar ratio of a:(1-a) to form a mixture; heating the mixture to form a molten mixture; casting and cooling molding, otherwise referred to herein as cold molding, the molten mixture to form the Zr-based amorphous alloy represented by the general formula of $(Zr_aM_{1-a})_{100-x}O_x$, in which: a is atomic fraction of Zr and x is atomic percent of oxygen, in which: $0.3 \leqq a \leqq 0.9$, and $0.02 \leqq x \leqq 0.6$; and M represents at least three elements selected from the group consisting of transition metals other than Zr, Group IIA metals, and Group IIIA metals in the Periodic Table of Elements. The Zr-based amorphous alloy prepared by the method according to an embodiment of the present disclosure may have enhanced plasticity.

According to the alternative embodiments of the present disclosure, the cold molding step may be performed in a mould (also spelled "mold") with a thermal conductivity of about 10 to about 400 watts per meter Kelvin (W/m·K), preferably about 30 to about 200 W/m·K. M may represent at least three elements selected from the group consisting of La series, Cu, Ag, Zn, Sc, Y, Ti, Zr, V, Nb, Ta, Cr, Mn, Fe, Co, Ni, Be, and Al. The casting temperature may be about 100° C. above the melting temperature of the Zr-based amorphous alloy. The mixing, heating, and casting steps may be performed under a protective gas or under vacuum. The protective gas may be at least one gas selected from the group consisting of nitrogen and Group VIII gases in the Periodic Table of Elements, preferably nitrogen. The vacuum degree may be less than about $1.01 \times 10^5$ pascal (Pa). The cold molding may be selected from gravity casting, suction casting, spray casting or die casting. The oxygen content may be acquired by well controlling the oxygen content in the raw materials and the environment.

Without wishing to be bound by the theory, Applicants believe that plastic strain of the Zr-based amorphous alloy may be enhanced by properly controlling the size and the oxygen content of the Zr-based amorphous alloy, the ratio of the crystalline phase to the amorphous phase, and the preparing conditions of the Zr-based amorphous alloy. The Zr-based amorphous alloy prepared by the method according to the present disclosure may have a plastic strain of more than about 1%, thus improving the safety of the Zr-based amorphous alloy when used as a structure part and broadening the application fields of the Zr-based amorphous alloy.

Additional aspects and advantages of the embodiments of the present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of the present disclosure will become apparent and more readily appreciated from the following descriptions taken in conjunction with the drawings in which.

DETAILED DESCRIPTION OF THE EMBODIMENT

Figure 1:
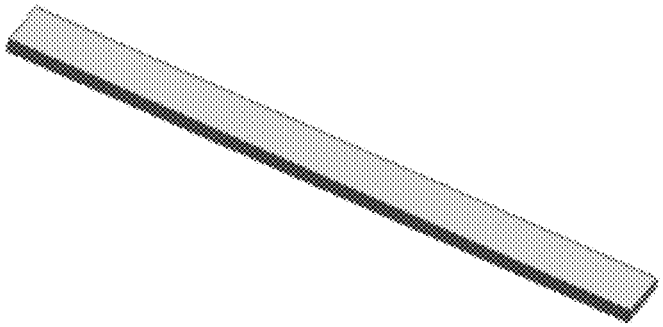
FIG. 1 shows a perspective view of a Zr-base amorphous alloy according to an embodiment of the present disclosure.

Reference will be made in detail to embodiments of the present disclosure. The embodiments described herein are explanatory, illustrative, and used to generally understand the present disclosure. The embodiments shall not be construed to limit the present disclosure. The same or similar elements and the elements having same or similar functions are denoted by like reference numerals throughout the descriptions.

According to an aspect of the present disclosure, a Zr-based amorphous alloy represented by the general formula of $(Zr_aM_{1-a})_{100-x}O_x$ is provided, in which a is atomic fraction of Zr, and x is atomic percent of oxygen in which: $0.3 \leqq a \leqq 0.9$, and $0.02 \leqq x \leqq 0.6$; and M represents at least three elements selected from the group consisting of transition metals other than Zr, Group IIA metals, and Group IIIA metals in the Periodic Table of Elements. The Zr-based amorphous alloy may comprise a crystalline phase with a volume percent of less than about 70% and an amorphous phase with a volume percent of more than about 30%. The Zr-based amorphous alloy may have multiple dimension sizes with at least one dimension size less than about 5 mm. The Zr-based amorphous alloy may have a plastic strain of more than about 1%.

In an alternative embodiment of the present disclosure, a Zr-based amorphous alloy represented by the general formula of $(Zr_aM_{1-a})_{100-x}O_x$, is provided, in which $0.4 \leqq a \leqq 0.7$; $0.03 \leqq x \leqq 0.5$; and M represents at least three elements selected from the group consisting of La series, Cu, Ag, Zn, Sc, Y, Ti, Zr, V, Nb, Ta, Cr, Mn, Fe, Co, Ni, Be, and Al. The Zr-based amorphous alloy may have a crystalline phase with a volume percent of less than about 37% and an amorphous phase with a volume percent of more than about 63%. The Zr-based amorphous alloy may have multiple dimension sizes with at least one dimension size less than about 2 mm.

Without wishing to be bound by the theory, Applicants believe that the compounding of materials may enhance the comprehensive performances of the materials, while the compounding of the amorphous alloy materials has also been applied and researched widely to enhance the comprehensive performances thereof The Zr-based amorphous alloy according to the present disclosure may comprise a crystalline phase with a volume percent of less than about 70%, which may not affect the performances of the Zr-based amorphous alloy, but may improve the mechanical properties thereof. Furthermore, the Zr-based amorphous alloy may have multiple dimension sizes, thus forming various kinds of free volumes, atomic clusters, and shear zones. As for the shear zones, the Zr-based amorphous alloy according to the present disclosure may have at least one dimension size of less than about 5 mm, preferably about 2 mm. The multiple dimension sizes of the Zr-based amorphous alloy may favor the increasing of the shear zones, and consequently may enhance the plastic deformability of the Zr-based amorphous alloy. Moreover, compared with a conventional amorphous alloy, the microstructure of the Zr-based amorphous alloy may improve the mechanical properties of the Zr-based amorphous alloy, particularly strength and plastic strain.

According to another aspect of the present disclosure, a method of preparing a Zr-based amorphous alloy may be provided. The method may comprise the steps of: mixing raw materials comprising Zr and M with a molar ratio of a:(1-a) to form a mixture; heating the mixture to form a molten mixture; casting and cold molding the molten mixture to form the Zr-based amorphous alloy represented by the general formula of $(Zr_aM_{1-a})_{100-x}O_x$, in which: a is atomic fraction of Zr, and x is atomic percent of oxygen, in which: $0.3 \leqq a \leqq 0.9$, and $0.02 \leqq x \leqq 0.6$. The mold may have a thermal conductivity of about 10 W/m·K to about 400 W/m·K. M may be at least three elements selected from the group consisting of transition metals other than Zr, Group IIA metals, and Group IIIA metals in the Periodic Table of Elements. The casting temperature may be about 100° C. above the melting temperature of the Zr-based amorphous alloy.

In an alternative embodiment of the present disclosure, a method of preparing a Zr-based amorphous alloy may be provided. The method may comprise the steps of: mixing raw materials comprising Zr and M with a molar ratio of a:(1-a) to form a mixture; heating the mixture to form a molten mixture; casting and cold molding the molten mixture to form the Zr-based amorphous alloy represented by the general formula of $(Zr_aM_{1-a})_{100-x}O_x$, in which: $0.4 \leqq a \leqq 0.7$, and $0.03 \leqq x \leqq 0.5$. The mold may have a thermal conductivity of about 30 W/m·K to about 200 W/m·K. M may be at least three elements selected from the group consisting of La series, Cu, Ag, Zn, Sc, Y, Ti, Zr, V, Nb, Ta, Cr, Mn, Fe, Co, Ni, Be, and Al. The casting temperature may be about 100-500° C. above the melting temperature of the Zr-based amorphous alloy.

The melting temperature of the Zr-based amorphous alloy may be dependent on the composition of the Zr-based amorphous alloy, and may be tested by differential scanning calorimetry (DSC).

In an embodiment of the present disclosure, the Zr-based amorphous alloy may have multiple dimension sizes, with at least one dimension size less than about 5 mm, preferably about 2 mm.

The raw materials for forming the Zr-based amorphous alloy may comprise Zr and M, and the composition of the Zr-based amorphous alloy may be varied by adjusting the amounts of Zr and M and the oxygen content in the raw materials. In an embodiment of the present disclosure, the Zr-based amorphous alloy may be represented by the general formula of $(Zr_aM_{1-a})_{100-x}O_x$, in which a is atomic fraction of Zr, and x is atomic percent of oxygen, in which: $0.3 \leqq a \leqq 0.9$, and $0.02 \leqq x \leqq 0.6$; and M represents at least three elements selected from the group consisting of transition metals other than Zr, Group IIA metals, and Group IIIA metals in the Periodic Table of Elements. The Zr-based amorphous alloy may comprise a crystalline phase with a volume percent of less than about 70% and an amorphous phase with a volume percent of more than about 30%. The Zr-based amorphous alloy may have multiple dimension sizes with at least one dimension size less than about 5 mm. The Zr-based amorphous alloy may have a plastic strain of more than about 1%.

In an alternative embodiment of the present disclosure, the Zr-based amorphous alloy may be represented by the general formula of $(Zr_aM_{1-a})_{100-x}O_x$, in which $0.4 \leqq a \leqq 0.7$; $0.03 \leqq x \leqq 0.5$; and M represents at least three elements selected from the group consisting of La series, Cu, Ag, Zn, Sc, Y, Ti, Zr, V, Nb, Ta, Cr, Mn, Fe, Co, Ni, Be, and Al. The Zr based amorphous alloy may have a crystalline phase with a volume percent of less than about 37% and an amorphous phase with a volume percent of more than about 63%. The Zr-based amorphous alloy may have multiple dimension sizes with at least one dimension size less than about 2 mm.

Oxygen in the amorphous alloy is generally considered as an impurity. Therefore, it has been considered that oxygen may not harm the crystalline properties of the amorphous alloy only by controlling the oxygen content in the amorphous alloy to a low content, for example, less than about 1 atomic percent. In other words, the higher the purity of the raw materials, that is, the lower the content of the impurity, the better the performance of the amorphous alloy is. In this way, the adverse influence of oxygen or other impurities on the amorphous alloy may be reduced. However, without wishing to be bound by the theory, Applicants believe that the plastic properties of the amorphous alloy may be significantly improved by controlling the oxygen content in a range of about 0.02-0.6 atomic percent, preferably about 0.03-0.5 atomic percent. In contrast, the amorphous alloy may exhibit poor plastic properties when the oxygen content is out of this range.

In an embodiment, the raw materials may be mixed according to the chemical composition of the Zr-based amorphous alloy, and melted under vacuum or a protective gas. The required oxygen in the Zr-based amorphous alloy may be provided by the oxygen in the raw materials and the melting environment, in which the melting environment may include: a melting device, the protective gas during the melting step, and the remaining gas in the melting device. Oxygen may be in an atomic state, or a chemical state. As the amount of oxygen from the environment is less, the oxygen content in the Zr-based amorphous alloy may be mainly determined by the oxygen content in the raw materials. In an alternative embodiment, the raw materials comprising Zr and M may have an oxygen content of about 0.005 atomic percent to about 0.05 atomic percent. The extra small oxygen content in the raw materials may cause an insufficient and uneven distribution of oxygen in the Zr-based amorphous alloy, whereas the extra large oxygen content in the raw materials may cause large amounts of oxygen in the Zr-based amorphous alloy, thus decreasing the performance of the Zr-based amorphous alloy.

The purity of the raw materials may be varied according to different Zr-based amorphous alloys. In an embodiment, the purity of the raw materials may be more than about 99%, and the oxygen content in the raw materials may be about 0.005 atomic percent to about 0.05 atomic percent.

The vacuum condition may be known to those skilled in the art. In an embodiment, the vacuum degree may be less than about $1.01\times10^5$ Pa. In an alternative embodiment, the vacuum degree may be less than about 1000 Pa. In a further alternative embodiment, the vacuum degree may be about $3\times10^{-5}$ Pa to about $10^2$ Pa (absolute pressure).

The protective gas may be known to those skilled in the art, such as an inert gas selected from the group consisting of nitrogen, Group XVIII gases in the Periodic Table of Elements, and combinations thereof. Due to the presence of a certain amount of oxygen in the Zr-based amorphous alloy, an inert gas with a concentration of no less than about 98% by volume may meet the requirements.

The melting step may be achieved by any conventional melting method in the art, provided that the raw materials for preparing the Zr-based amorphous alloy are melted sufficiently, for example, melting in a vacuum melting device. The melting temperature and the melting time may be varied according to different raw materials. In an embodiment, the melting may be performed in a conventional vacuum melting device, such as a vacuum arc melting furnace, a vacuum induction melting furnace, or a vacuum resistance furnace.

According to an embodiment of the present disclosure, the raw materials may be mixed to form a mixture; then the mixture may be heated to a casting temperature to form a molten mixture; and then cast and cold molded to form the Zr-based amorphous alloy. The higher the casting temperature, the lower the required casting pressure is; whereas the lower the casting temperature, the higher the required casting pressure is. Without wishing to be bound by the theory, Applicants believe that a Zr-based amorphous alloy with plastic strain may be obtained when the casting temperature is about 100° C. above the melting temperature. In an alternative embodiment, the casting temperature is about 100° C. to about 500° C. above the melting temperature, to facilitate the casting step and the subsequent cold molding steps. In a further alternative embodiment, the casting temperature is about 100° C. to about 200° C. above the melting temperature. The cold molding step may be achieved by any method well-known in the art, such as a casting method. In some embodiment, the casting may be selected from gravity casting, suction casting, spray casting or die casting. In a further embodiment, the casting may be high pressure casting. The process and the condition of the high pressure casting may be well-known in the art. For example, the high pressure casting may be performed under a pressure of about 2 MPa to about 20 MPa.

According to an embodiment of the present disclosure, the high pressure casting may be performed in a mold, and the mold may be any conventional one in the art. The cooling speed during the cold molding step may be well controlled by using a mold with suitable thermal conductivity, thus obtaining a Zr-based amorphous alloy with stable properties. In an embodiment, the mold may have a thermal conductivity of about 10 W/m·K to about 400 W/m·K. In an alternative embodiment, the mold may have a thermal conductivity of about 30 W/m·K to about 200 W/m·K. Furthermore, a Zr-based amorphous alloy with a certain size may be obtained by changing the cavity of the mold. In this way, the Zr-based amorphous alloy with at least one dimension size of less than about 5 mm may be obtained.

According to an embodiment of the present disclosure, the mold may cooled by water or oil. There are no special limits on the cooling degree of the molten mixture, provided that the Zr-based amorphous alloy is formed.

The following provides additional details of some embodiments of the present disclosure.

Embodiment 1

A method of preparing a Zr-based amorphous alloy comprises the following steps.

100 g of raw materials comprising Zr with an oxygen content of about 0.005 atomic percent, Ti with an oxygen content of about 0.01 atomic percent, Cu with an oxygen content of about 0.005 atomic percent, Ni with an oxygen content of about 0.005 atomic percent, and Be with an oxygen content of about 0.005 atomic percent according to the composition of the Zr-based amorphous alloy were placed in a vacuum induction furnace. The vacuum induction furnace was vacuumized to a vacuum degree of about 50 Pa, then argon with a purity of about 99% by volume was filled in the vacuum induction furnace. The raw materials were melted sufficiently at a temperature of about 1500° C., then cast into an ingot. The ingot was tested by inductively coupled plasma (ICP) analysis and oxygen content analysis. The results indicated that the ignot had a composition of $(Zr_{0.41}Ti_{0.14}Cu_{0.15}Ni_{0.10}Be_{0.20})_{99.925}O_{0.075}$.

The ingot was heated to a casting temperature of about 805° C., then die-cast under a casting pressure of about 5 MPa in a mold with a thermal conductivity of about 60 W/m·K. The cast ingot was molded with cooling to form the Zr-based amorphous alloy sample C1 with a size of about 180 mm×10 mm×2 mm. The melting temperature of the Zr-based amorphous alloy sample C1 was about 705° C.

Comparative Embodiment 1

A method of preparing a Zr-based amorphous alloy comprises the following steps.

100 g of raw materials comprising Zr with an oxygen content of about 0.003 atomic percent, Ti with an oxygen content of about 0.003 atomic percent, Cu with an oxygen content of about 0.005 atomic percent, Ni with an oxygen content of about 0.002 atomic percent, and Be with an oxygen content of about 0.005 atomic percent according to the composition of the Zr-based amorphous alloy were placed in a vacuum induction furnace. The vacuum induction furnace was vacuumized to a vacuum degree of about 50 Pa, then argon with a purity of about 99% by volume was filled in the vacuum induction furnace. The raw materials were melted sufficiently at a temperature of about 1500° C., then cast into an ingot. The ingot was tested by inductively coupled plasma (ICP) analysis and oxygen content analysis. The results indicated that the ignot had a composition of $(Zr_{0.41}Ti_{0.14}Cu_{0.15}Ni_{0.10}Be_{0.20})_{99.99}O_{0.01}$.

The ingot was heated to a casting temperature of about 805° C., then die-cast under a casting pressure of about 5 MPa in a mold with a thermal conductivity of about 60 W/m·K. The cast ingot was molded with cooling to form the Zr-based amorphous alloy sample D1 with a size of about 180 mm×10 mm×6 mm. The melting temperature of the Zr-based amorphous alloy sample D1 was about 705° C.

Embodiment 2

A method of preparing a Zr-based amorphous alloy comprises the following steps.

100 g of raw materials comprising Zr with an oxygen content of about 0.005 atomic percent, Al with an oxygen content of about 0.01 atomic percent, Cu with an oxygen content of about 0.005 atomic percent, and Ni with an oxygen content of about 0.006 atomic percent according to the composition of the Zr-based amorphous alloy were placed in a vacuum induction furnace. The vacuum induction furnace was vacuumized to a vacuum degree of about 0.1 Pa, then argon with a purity of about 99% by volume was filled in the vacuum induction furnace. The raw materials were melted sufficiently at a temperature of about 1500° C., then cast into an ingot. The ingot was tested by inductively coupled plasma (ICP) analysis and oxygen content analysis. The results indicated that the ignot had a composition of $(Zr_{0.55}Al_{0.15}Cu_{0.25}Ni_{0.05})_{99.955}O_{0.045}$.

The ingot was heated to a casting temperature of about 950° C., then die-cast under a casting pressure of about 5 MPa in a mold with a thermal conductivity of about 100 W/m·K. The cast ingot was molded with cooling to form the Zr-based amorphous alloy sample C2 with a size of about 180 mm×10 mm×1 mm. The melting temperature of the Zr-based amorphous alloy sample C2 was about 840° C.

Comparative Embodiment 2

A method of preparing a Zr-based amorphous alloy comprises the following steps.

100 g of raw materials comprising Zr with an oxygen content of about 0.08 atomic percent, Al with an oxygen content of about 0.01 atomic percent, Cu with an oxygen content of about 0.005 atomic percent, and Ni with an oxygen content of about 0.08 atomic percent according to the composition of the Zr-based amorphous alloy were placed in a vacuum induction furnace. The vacuum induction furnace was vacuumized to a vacuum degree of about 500 Pa, then argon with a purity of about 95% by volume was filled in the vacuum induction furnace. The raw materials were melted sufficiently at a temperature of about 1500° C., then cast into an ingot. The ingot was tested by inductively coupled plasma (ICP) analysis and oxygen content analysis. The results indicated that the ignot had a composition of $(Zr_{0.55}Al_{0.15}Cu_{0.25}Ni_{0.05})_{98.9}O_{1.1}$.

The ingot was heated to a casting temperature of about 950° C., then die-cast under a casting pressure of about 5 MPa in a mold with a thermal conductivity of about 100 W/m·K. The cast ingot was molded with cooling to form the Zr-based amorphous alloy sample D1 with a size of about 180 mm×10 mm×1 mm. The melting temperature of the Zr-based amorphous alloy sample D2 was about 840° C.

Embodiment 3

A method of preparing a Zr-based amorphous alloy comprises the following steps.

100 g of raw materials comprising Zr with an oxygen content of about 0.003 atomic percent, Ti with an oxygen content of about 0.005 atomic percent, Nb with an oxygen content of about 0.005 atomic percent, Cu with an oxygen content of about 0.005 atomic percent, Ni with an oxygen content of about 0.008 atomic percent, and Be with an oxygen content of about 0.02 atomic percent according to the composition of the Zr-based amorphous alloy were placed in a vacuum induction furnace. The vacuum induction furnace was vacuumized to a vacuum degree of about 50 Pa, then argon with a purity of about 99% by volume was filled in the vacuum induction furnace. The raw materials were melted sufficiently at a temperature of about 1500° C., then cast into an ingot. The ingot was tested by inductively coupled plasma (ICP) analysis and oxygen content analysis. The results indicated that the ignot had a composition of $(Zr_{0.56}Ti_{0.14}Nb_{0.05}Cu_{0.07}Ni_{0.06}Be_{0.12})_{99.965}O_{0.035}$.

The ingot was remelted and heated to a casting temperature of about 900° C., then die-cast under a casting pressure of about 5 MPa in a mold with a thermal conductivity of about 150 W/m·K. The cast ingot was molded with cooling to form the Zr-based amorphous alloy sample C3 with a size of about 180 mm×10 mm×0.5 mm. The melting temperature of the Zr-based amorphous alloy sample C3 was about 718° C.

Comparative Embodiment 3

A method of preparing a Zr-based amorphous alloy comprises the following steps.

100 g of raw materials comprising Zr with an oxygen content of about 0.003 atomic percent, Ti with an oxygen content of about 0.003 atomic percent, Nb with an oxygen content of about 0.005 atomic percent, Cu with an oxygen content of about 0.005 atomic percent, Ni with an oxygen content of about 0.002 atomic percent, and Be with an oxygen content of about 0.005 atomic percent according to the composition of the Zr-based amorphous alloy were placed in a vacuum induction furnace. The vacuum induction furnace was vacuumized to a vacuum degree of about 50 Pa, then argon with a purity of about 99% by volume was filled in the vacuum induction furnace. The raw materials were melted sufficiently at a temperature of about 1500° C., then cast into an ingot. The ingot was tested by inductively coupled plasma (ICP) analysis and oxygen content analysis. The results indicated that the ignot had a composition of $(Zr_{0.345}Ti_{0.115}Nb_{0.09}Cu_{0.125}Ni_{0.1}Be_{0.225})_{99.2}O_{0.8}$.

The ingot was remelted and heated to a casting temperature of about 900° C., then die-cast under a casting pressure of about 5 MPa in a mold with a thermal conductivity of about 5 W/m·K. The cast ingot was molded with cooling form the Zr-based amorphous alloy sample D3 with a size of about 180 mm×10 mm×0.5 min. The melting temperature of the Zr-based amorphous alloy sample D3 was about 718° C.

Embodiment 4

A method of preparing a Zr-based amorphous alloy comprises the following steps.

100 g of raw materials comprising Zr with an oxygen content of about 0.005 atomic percent, Ti with an oxygen content of about 0.04 atomic percent, Nb with an oxygen content of about 0.005 atomic percent, Cu with an oxygen content of about 0.03 atomic percent, Ni with an oxygen content of about 0.02 atomic percent, and Be with an oxygen content of about 0.014 atomic percent according to the composition of the Zr-based amorphous alloy were placed in a vacuum induction furnace. The vacuum induction furnace was vacuumized to a vacuum degree of about 50 Pa, then argon with a purity of about 99% by volume was filled in the vacuum induction furnace. The raw materials were melted sufficiently at a temperature of about 1500° C., then cast into an ingot. The ingot was tested by inductively coupled plasma (ICP) analysis and oxygen content analysis. The results indicated that the ignot had a composition of $(Zr_{0.65}Ti_{0.10}Nb_{0.05}Cu_{0.08}Ni_{0.07}Be_{0.05})_{99.875}O_{0.125}$.

The ingot was remelted and heated to a casting temperature of about 855° C., then die-cast under a casting pressure of about 5 MPa in a mold with a thermal conductivity of about 200 W/m·K. The cast ingot was molded with cooling to form the Zr-based amorphous alloy sample C4 with a size of about 180 mm×10 mm×1 mm. The melting temperature of the Zr-based amorphous alloy sample C4 was about 750° C.

Embodiment 5

A method of preparing a Zr-based amorphous alloy comprises the following steps.

100 g of raw materials comprising Zr with an oxygen content of about 0.03 atomic percent, Ti with an oxygen content of about 0.005 atomic percent, Nb with an oxygen content of about 0.005 atomic percent, Cu with an oxygen content of about 0.009 atomic percent, Ni with an oxygen content of about 0.004 atomic percent, and Be with an oxygen content of about 0.007 atomic percent according to the composition of the Zr-based amorphous alloy were placed in a vacuum induction furnace. The vacuum induction furnace was vacuumized to a vacuum degree of about 50 Pa, then argon with a purity of about 99% by volume was filled in the vacuum induction furnace. The raw materials were melted sufficiently at a temperature of about 1500° C., then cast into an ingot. The ingot was tested by inductively coupled plasma (ICP) analysis and oxygen content analysis. The results indicated that the ignot had a composition of $(Zr_{0.70}Ti_{0.06}Nb_{0.05}Cu_{0.05}Ni_{0.08}Be_{0.06})_{99.545}O_{0.455}$.

The ingot was remelted and heated to a casting temperature of about 850° C., then die-cast under a casting pressure of about 5 MPa in a mold with a thermal conductivity of about 200 W/m·K. The cast ingot was molded with cooling to form the Zr-based amorphous alloy sample C5 with a size of about 180 mm×10 mm×1 mm. The melting temperature of the Zr-based amorphous alloy sample C5 was about 744° C.

Embodiment 6

A method of preparing a Zr-based amorphous alloy comprises the following steps.

100 g of raw materials comprising Zr with an oxygen content of about 0.01 atomic percent, Nb with an oxygen content of about 0.005 atomic percent, Cu with an oxygen content of about 0.005 atomic percent, Ni with an oxygen content of about 0.005 atomic percent, Co with an oxygen content of about 0.005 atomic percent, Fe with an oxygen content of about 0.005 atomic percent, and Be with an oxygen content of about 0.005 atomic percent according to the composition of the Zr-based amorphous alloy were placed in a vacuum induction furnace. The vacuum induction furnace was vacuumized to a vacuum degree of about 50 Pa, then argon with a purity of about 99% by volume was filled in the vacuum induction furnace. The raw materials were melted sufficiently at a temperature of about 1500° C., then cast into an ingot. The ingot was tested by inductively coupled plasma (ICP) analysis and oxygen content analysis. The results indicated that the ignot had a composition of $(Zr_{0.57}Ti_{0.06}Nb_{0.05}Cu_{0.05}Ni_{0.08}Co_{0.05}Fe_{0.08}Be_{0.06})_{99.45}O_{0.55}$.

The ingot was remelted and heated to a casting temperature of about 950° C., then die-cast under a casting pressure of about 5 MPa in a mold with a thermal conductivity of about 150 W/m·K. The cast ingot was molded with cooling to form the Zr-based amorphous alloy sample C6 with a size of about 180 mm×10 mm×4 mm. The melting temperature of the Zr-based amorphous alloy sample C6 was about 827° C.

Test

1) ICP

The Zr-based amorphous alloy samples C1-6 and D1-3 were respectively tested on an iCAP6300-CPA Inductively Coupled Plasma Atomic Emission Spectrometer (ICP-AES) under the conditions of: a wavelength of about 166 nm to about 847 nm, a focal length of about 383 nm, a resolution of about 0.007 nm at a distance of about 200 nm, and a detection limit of about 0.002 grams per liter (g/L) to about 0.2 g/L.

The testing results were shown in Table 1.

2) Oxygen Content

The Zr-based amorphous alloy samples C1-6 and D1-3 were respectively tested on an IRO-II infrared oxygen content analyzer commercially available from Beijing NCS Analytical Instruments Co., Ltd. by a combustion method, using argon as a protective gas, while the crucible was made of graphite.

3) Bending Strength

Figure 2:
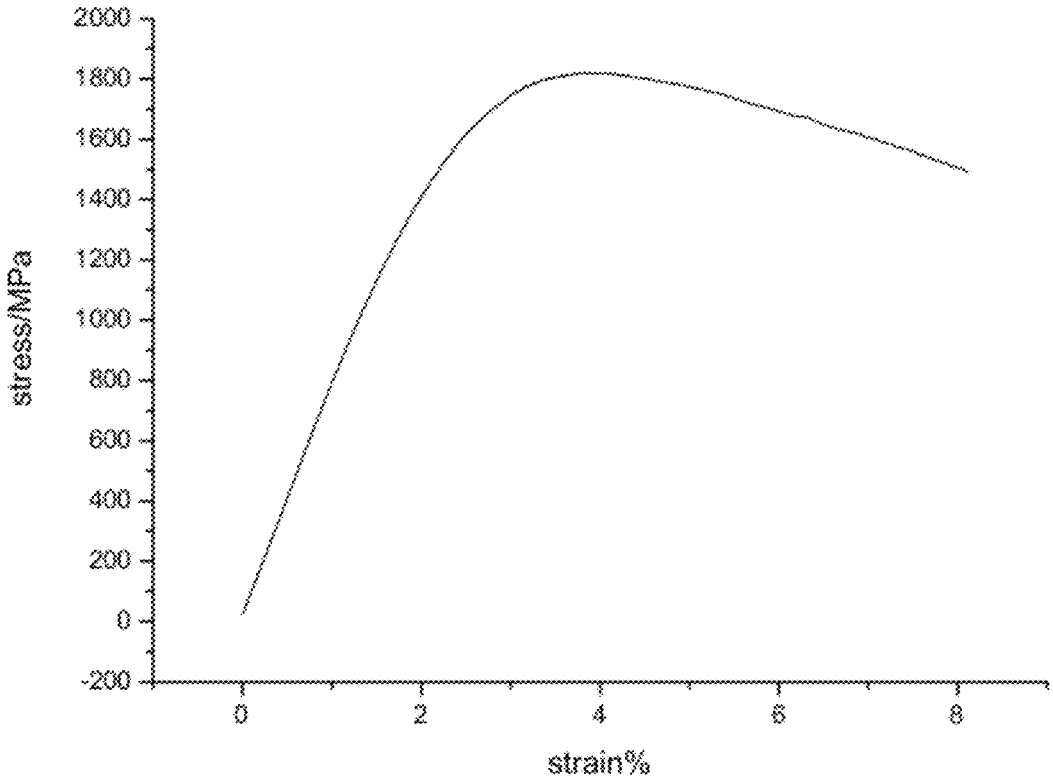
FIG. 2 shows stress-strain curves of samples C1-3 according to an embodiment of the present disclosure.

The Zr-based amorphous alloy samples C1-6 and D1-3 were respectively tested on a CMT5000 testing machine with a tonnage of about 100 ton commercially available from Shenzhen Sans Testing Machine Co., Ltd., P.R.C. under the conditions of a loading speed of about 0.5 mm/min and a span of about 50 mm, to obtain the bending strength of the Zr-based amorphous alloys C1-6 and D1-3, thus obtaining the plastic strain data thereof. The testing results were shown in Table 1. The stress-strain curves of the Zr based amorphous alloy samples C1-3 were shown in FIG. 2.

4) XRD

Figure 3:
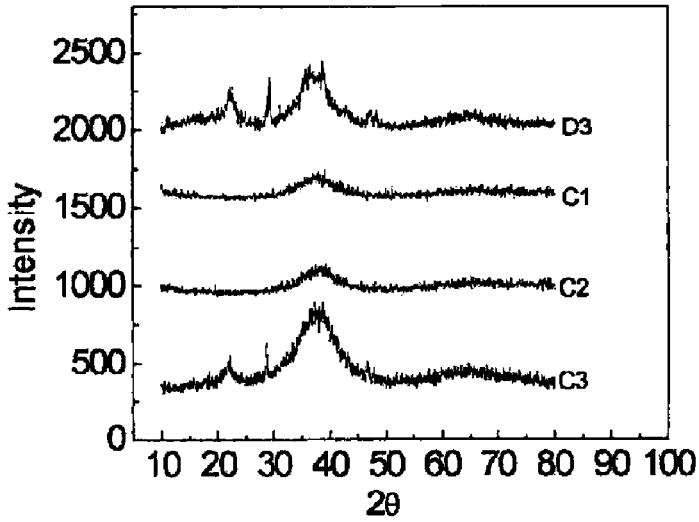
FIG. 3 shows XRD patterns of C1-3 and D3 according to an embodiment of the present disclosure.

The Zr-based amorphous alloy samples C1-3 and D3 were respectively tested on a 5 D-MAX2200PC X-ray powder diffactometer under the conditions of: a copper target, an incident wavelength of about 1.54060A, an accelerating voltage of about 40 KV, a current of about 20 mA, and a scanning step of about 0.04°, The XRD patterns of the Zr-based amorphous alloy samples C1-3 and D3 were shown in FIG. 3.

5) DSC

The Zr-based amorphous alloy samples C1-6 and D1-3 were respectively tested on a NETZSCH STA 449C machine commercially available from NETZSCH Instruments Co., Ltd., Germany, under the conditions of: a heating rate of about 50 K./min, and a sample weight of about 1000 mg, using argon as a protective gas. The melting temperature of each Zr-based amorphous alloy sample may be determined by the DSC pattern thereof. The testing results were shown in Table 1.

TABLE 1

| No. | Melting Temperature (° C.) | Casting Temperature (° C.) | Percent of Crystalline Phase (%) | Percent of Amorphous Phase (%) | Oxygen Content | Thermal Conductivity (W/m · K) | Size (Length × Width × Height) | Plastic Straing (%) |
|---|---|---|---|---|---|---|---|---|
| C1 | 705 | 805 | 5 | 95 | 0.075 | 60 | 100 × 10 × 2 | 37.5 |
| C2 | 840 | 950 | 5 | 95 | 0.045 | 100 | 180 × 10 × 1 | 7 |
| C3 | 718 | 900 | 30 | 70 | 0.035 | 150 | 180 × 10 × 0.5 | 8 |
| C4 | 750 | 855 | 25 | 75 | 0.125 | 200 | 180 × 10 × 1 | 4 |
| C5 | 744 | 850 | 14 | 86 | 0.455 | 200 | 180 × 10 × 1 | 3.5 |
| C6 | 827 | 950 | 23 | 77 | 0.55 | 150 | 180 × 10 × 4 | 3.5 |
| D1 | 705 | 805 | 5 | 95 | 0.01 | 60 | 180 × 10 × 6 | 0.3 |
| D2 | 840 | 950 | 5 | 95 | 1.1 | 100 | 180 × 10 × 1 | 0.2 |
| D3 | 718 | 900 | 40 | 60 | 0.8 | 5 | 180 × 10 × 0.5 | 0.5 |

As shown in Table 1, the Zr-based amorphous alloy according to the present disclosure may have enhanced plastic properties by well controlling the composition and the oxygen content of the Zr-based amorphous alloy, the casting temperature, the cooling condition, and the size of the Zr-based amorphous alloy.

Figure 4:
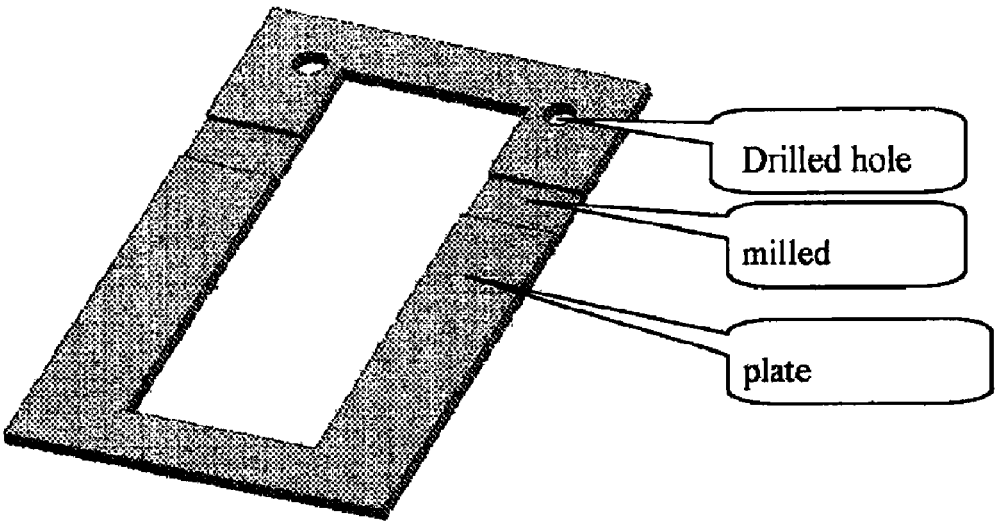
FIG. 4 shows a perspective view of an article made of Zr-based amorphous alloy according to an embodiment of the present disclosure.

The Zr-based amorphous alloy according to the present disclosure may have multiple dimension sizes with at least one dimension size of no less than about 5 mm, preferably about 2 mm, which may be applied in various fields such as precision instruments and sports instruments. The Zr-based amorphous alloy according to the present disclosure may have excellent properties, such as excellent elasticity recovery capability, certain plastic deformability, excellent wear resistance and excellent corrosion resistance, and consequently may be formed into various shapes and structures, including, but not limited to, an article shown in FIG. 4.

Although the present disclosure have been described in detail with reference to several embodiments, additional variations and modifications exist within the scope and spirit as described and defined in the following claims.

What is claimed is:

1. A Zr-based amorphous alloy having a formula of: $(Zr_aM_{1-a})_{100-x}O_x$, wherein:

a is an atomic fraction of Zr, and x is an atomic percent of oxygen, in which: $0.3 \leqq a \leqq 0.9$, and $0.02 \leqq x \leqq 0.6$; and M represents at least three elements selected from the group consisting of transition metals other than Zr, Group HA metals, and Group MA metals, wherein, the Zr-based amorphous alloy has a crystalline phase of less than about 70% by volume based on the total volume of the Zr-based amorphous alloy; multiple dimension sizes with at least one dimension size less than about 5 mm; and a plastic strain of more than 3.5%.

2. The Zr-based amorphous alloy of claim 1, wherein the Zr-based amorphous alloy has a crystalline phase of less than about 37% by volume based on the total volume of the Zr-based amorphous alloy.

3. The Zr-based amorphous alloy of claim 1, wherein the Zr-based amorphous alloy has multiple dimension sizes with at least one dimension size less than about 2mm.

4. The Zr-based amorphous alloy of claim 1, wherein: $0.4 \leqq a \leqq 0.7$; $0.03 \leqq x \leqq 0.5$; and M represents at least three elements selected from the group consisting of La series, Cu, Ag, Zn, Sc, Y, Ti, V, Nb, Ta, Cr, Mn, Fe, Co, Ni, Be, and Al.

5. A method comprising:

mixing raw materials comprising Zr and M with a molar ratio of a:(1-a) to form a mixture;

heating the mixture to form a molten mixture;

casting at a temperature ranging from about 100° C. to about 500° C. above the melting temperature of the Zr-based amorphous alloy, and cold molding the molten mixture to form the Zr-based amorphous alloy of claim 1.

6. The method of claim 5, wherein the mixing, heating, and casting steps are performed under a protective gas or vacuum.

7. The method of claim 6, wherein the protective gas is at least one gas selected from the group consisting of nitrogen and Group XVIII gases.

8. The method of claim 5, wherein the cold molding step is performed in a mold with a thermal conductivity ranging from about 10 W/m·K to about 400 W/m·K.

9. The method of claim 8, wherein the cold molding step is performed in a mold with a thermal conductivity ranging from about 30 W/m·K to about 200 W/m·K.

10. The method of claim 5, wherein the casting step is performed under a casting temperature of about 100° C. above the melting temperature of the Zr-based amorphous alloy.

11. The method of claim 5, wherein the Zr-based amorphous alloy has multiple dimension sizes with at least one dimension size less than about 2 mm.

12. The method of claim 5, wherein:

$0.4 \leqq a \leqq 0.7$;

$0.03 \leqq x \leqq 0.5$; and

M represents at least three elements selected from the group consisting of La series, Cu, Ag, Zn, Sc, Y, Ti, V, Nb, Ta, Cr, Mn, Fe, Co, Ni, Be, and Al.

13. The method of claim 5, wherein the cold molding is selected from the group consisting of: gravity casting, suction casting, spray casting and die casting.

* * * * *